US012134507B2

(12) United States Patent
Brust-Draxler et al.

(10) Patent No.: US 12,134,507 B2
(45) Date of Patent: Nov. 5, 2024

(54) TRANSPORT CONTAINER FOR SILICON FRAGMENTS

(71) Applicant: Wacker Chemie AG, Munich (DE)

(72) Inventors: Thomas Brust-Draxler, Burgkirchen (DE); Franz Bergmann, Mehring (DE)

(73) Assignee: Wacker Chemie AG, Munich (DE)

( * ) Notice: Subject to any disclaimer, the term of this patent is extended or adjusted under 35 U.S.C. 154(b) by 36 days.

(21) Appl. No.: 18/015,550

(22) PCT Filed: Mar. 24, 2021

(86) PCT No.: PCT/EP2021/057593
§ 371 (c)(1),
(2) Date: Jan. 11, 2023

(87) PCT Pub. No.: WO2022/199813
PCT Pub. Date: Sep. 29, 2022

(65) Prior Publication Data
US 2023/0249886 A1 Aug. 10, 2023

(51) Int. Cl.
*B65D 77/02* (2006.01)
*B65D 71/00* (2006.01)
*B65D 75/38* (2006.01)
*B65D 81/20* (2006.01)

(52) U.S. Cl.
CPC ..... *B65D 77/02* (2013.01); *B65D 71/0096* (2013.01); *B65D 75/38* (2013.01); *B65D 81/20* (2013.01)

(58) Field of Classification Search
CPC ..... B65D 77/02; B65D 77/00; B65D 77/04; B65D 71/0096; B65D 71/0092; B65D 71/0088; B65D 71/02; B65D 75/38; B65D 81/20; B65D 81/2023; B65D 5/58; B65D 65/40; B65D 65/46; B65D 85/62; B32B 27/08
USPC ..... 206/524.1, 524.6, 527, 521, 499
See application file for complete search history.

(56) References Cited

U.S. PATENT DOCUMENTS

| | | | | |
|---|---|---|---|---|
| 6,220,702 | B1 * | 4/2001 | Nakamura | B41J 2/17503 206/524.8 |
| 2009/0056279 | A1 * | 3/2009 | Sasaki | B65D 31/04 53/469 |
| 2010/0154357 | A1 * | 6/2010 | Wochner | B65B 25/00 53/370.7 |
| 2016/0167862 | A1 * | 6/2016 | Lichtenegger | B65B 29/00 206/386 |

FOREIGN PATENT DOCUMENTS

| | | | | |
|---|---|---|---|---|
| DE | 102006016324 | A1 | 10/2007 | |
| DE | 102013218003 | A1 | 3/2015 | |
| EP | 2730510 | A1 | 5/2014 | |
| EP | 2743190 | A1 | 6/2014 | |
| JP | 2000264375 | A | 9/2000 | |
| JP | 2017036066 | A | 2/2017 | |
| WO | WO-2015007490 | A1 * | 1/2015 | B65B 25/00 |

* cited by examiner

*Primary Examiner* — Javier A Pagan

(57) ABSTRACT

A transport container. The transport container is used for the packaging and transportation of silicon fragments. Where the transport container includes 8 to 14 flat film bags or 8 to 12 flat double film bags that contain an amount of the silicon fragments therein.

14 Claims, 5 Drawing Sheets

TRANSPORT CONTAINER FOR SILICON FRAGMENTS

CROSS-REFERENCE TO RELATED APPLICATIONS

Figure 1:
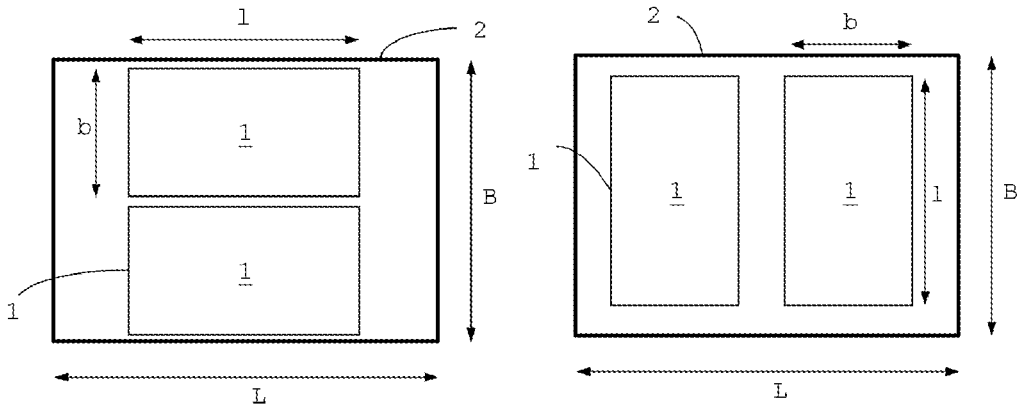

This application is a U.S. National Phase application of PCT Application No. PCT/EP2021/057593 filed on Mar. 24, 2021, the disclosure of which is incorporated by reference herein in its entirety.

The invention relates to a transport container containing at least three film bags or at least three double film bags, each filled with silicon fragments.

Polycrystalline silicon (polysilicon) is produced usually by the Siemens process (chemical vapour deposition process). Polysilicon is the starting material in the production of monocrystalline silicon, which is produced by means of the Czochralski process, for example. Polysilicon is also needed for the production of multicrystalline silicon, by means of block casting processes, for example. Both processes require the polysilicon obtained in the form of ingots by the Siemens process to be comminuted, generally into fragments.

Because instances of contamination can lead to dislocation defects (one-dimensional disruptions) and stacking defects (two-dimensional disruptions) in the crystal structure, the silicon fragments ought to be packaged, for transport, in a manner that minimizes contamination. Packaging takes place usually in welded plastic film bags or double film bags. Double film bags are able to reduce the risk of punctures by the usually sharp-edged fragments. For efficient transport, the bags are arranged, in a wide variety of different numbers, in surrounding packaging, usually cardboard boxes. The surrounding packaging forms can then be stacked on conventional pallets and, where appropriate, placed into freight containers.

Bag puncturing may occur not only during filling but also during transport, particularly as a result of vibrations, shaking and shifts in position of the bags. These events also lead in general to a further comminution, which is unwanted. Before further use, the fine fraction resulting from this further comminution must in principle be removed, in an additional operation, since it is detrimental to the further-processing operations.

30 The main cause of punctures and further comminution lies in an excessive freedom of movement of the bags in the surrounding packaging and also of the fragments in the bag itself. On the other hand, too high a packing density in the bag and/or in the surrounding packaging promotes puncturing and associated contamination.

WO 2015/007490 A1 discloses a transport container which contains at least two plastic bags with polysilicon fragments and has a packing density of 650 kg/m3 to at most 950 kg/m3. The plastic bags are arranged with a partial overlap, and the total volume of each bag, in relation to the volume of the fragments within it, is 2.4 to 3.0. A disadvantage is that the arrangement of the bags produces voids and fails to ensure optimal space utilization in the loading of freight containers.

For maximum economy of transport over land and sea, a high packing density would be advantageous, in order to be able to achieve maximum utilization of the payload of, for example, ISO containers (freight containers; cf. ISO standard 668). For the reasons stated, however, it is necessary to find a middle way which minimizes the risks both of contamination and of further comminution. This quandary provided the present invention with its object.

This object is achieved by means of a transport container which contains at least three film bags or at least three double film bags, each filled with silicon fragments. The film bags have in each case a packing density of 0.88 to 1.62 kg/dm$^3$, preferably of 0.99 to 1.49 kg/dm$^3$. The double film bags have in each case a packing density of 0.68 to 1.15 kg/dm$^3$, preferably of 0.77 to 1.05 kg/dm$^3$.

The transport container containing film bags has a packing density of 0.81 to 1.23 kg/dm$^3$, preferably of 0.89 to 1.14 kg/dm$^3$.

The transport container containing double film bags has a packing density of 0.65 to 1.06 kg/dm$^3$, preferably of 0.73 to 0.97 kg/dm$^3$.

It is the case here that the packing density of the film bag or double film bag is greater than or equal to the packing density of the transport container. Furthermore, the silicon fragments belong to at least one of the fragment size classes 0, 1, 2, 3 or 4.

The packing density of the film bag (single film bag) is defined as the ratio of the weight of the silicon fragments contained (contents weight) to the bag volume.

The bags are preferably double film bags, comprising a first and a second film bag. The silicon fragments are located in the first film bag, which is surrounded by the second film bag.

The packing density of the double film bag is defined as the ratio of the weight of the contents to the volume of the second film bag. In calculating the packing density, the weight of all the packaging materials can be disregarded. In general, in the filled and sealed state, the air enclosed between the first and second bags (which may be an inert gas) increases the volume of the double film bag.

The first and second film bags may have the same dimensions in the unfilled state. The first and second film bags may also be made of the same material. The thickness of the film, however, may differ. It may where appropriate be preferable for the second film bag to be made of a more robust material than the first film bag.

The film bags consist preferably of a plastic. This is more preferably polyethylene (PE), polyethylene terephthalate (PET) or polypropylene (PP). The film bag may also consist of a two-layer or multilayer composite film. The thickness of the film or composite film is situated customarily in a range from 10 to 1000 μm, preferably from 50 to 500 μm, more preferably from 100 to 300 μm. The film bags generally have airtight closure, and may be closed by welding, adhesive bonding, stitching or form-fitting. Where appropriate, the film bags are at least partly evacuated during filling. For the design of the film bags, their filling and sealing, reference may be made to EP 2 743 190 A1 and EP 2 730 510 A1.

The volume of the closed film bags may be determined by displacement in a water bath, with the displaced water corresponding to the bag volume.

The packing density of the transport container is defined as the ratio of the weight of the contents to the internal volume of the transport container.

The transport container consists preferably of card and more particularly has a cuboidal form (e.g. folding carton, where lid and base may each be formed from four closure flaps).

The film bag and double film bag contain, in particular, silicon fragments of one fragment size class. The fragments in question are preferably polysilicon fragments. One transport container commonly contains silicon fragments of the same fragment size class. It may be preferable to combine film bags or double film bags filled with silicon fragments of different fragment size classes in one transport container. It may also be preferable to mix silicon fragments from more than one of the fragment size classes 0 to 4 in one film bag or double film bag.

The fragment size classes 0 to 4 (CS0 to CS4) are defined on the basis of the particle size of the fragments, with the particle size being defined as the longest distance between two points on the surface of a silicon fragment. The fragment size classes bring together fractions having particle size ranges as follows:

CS0: 0.1 to 9 mm
CS1: 1 to 18 mm
CS2: 5 to 50 mm
CS3: 20 to 65 mm
CS4: 35 to 150 mm

The silicon fragments may be classified using mesh screens, with the edge length of the square meshes corresponding to the upper limit of one CS. For example, DE 10 2013 218 003 A1 describes a classifying method using vibrating screens, while DE 10 2006 016 324 A1 discloses an optopneumatic classifying method.

One CS preferably encompasses at least 90% by weight of silicon fragments within the respective size range.

It has emerged that relative to existing packaging for silicon, the transport container allows a significantly greater amount of silicon to be transported per unit volume available, without favouring the formation of fines and punctures. It has been possible in particular to increase the utilization of the permissible payload of ISO containers, with significant resultant savings in the transport costs. The advantages all in all may be summarized as follows:

- Increasing the quality of the silicon after transport: the restrictive mobility of the silicon in the bags and also of the bags in the transport container makes for fewer fines and punctures.
- Increasing the load capacity: for example, the loading of 20-foot ISO containers with the transport containers of the invention is accompanied by load capacity increases of up to 25%.
- Reducing the operating steps required in logistics. This reduction derives in particular from the reduced number of transport containers to be loaded, in comparison to existing transport.
- Reducing the packaging per kilogram of silicon transported.
- Increasing the operational stability of automated loading operations. The reduced number of required transport containers which have to be processed makes for a possible reduction in error rate by 10 to 25%.

Preference is given to transporting silicon fragments of CS0, where the film bags each have a packing density of 0.9 to 1.34 kg/dm$^3$, preferably of 1.01 to 1.23 kg/dm$^3$. When double film bags are used instead of the film bags, they have in each case a packing density of 0.68 to 1.02 kg/dm$^3$, preferably of 0.77 to 0.94 kg/dm$^3$.

According to another preferred embodiment, the silicon fragments are of CS1. The film bags in this case each have a packing density of 0.88 to 1.32 kg/dm$^3$, preferably of 0.99 to 1.21 kg/dm$^3$, and the double film bags each have a packing density of 0.68 to 1.03 kg/dm$^3$, preferably of 0.77 to 0.94 kg/dm$^3$.

The silicon fragments in question may also be of CS2, transported in the transport container. The film bags in this case each have a packing density of 1.07 to 1.61 kg/dm$^3$, preferably of 1.20 to 1.47 kg/dm$^3$, and the double film bags each have a packing density of 0.76 to 1.15 kg/dm$^3$, preferably of 0.86 to 1.05 kg/dm$^3$.

Another preferred embodiment relates to transport containers with silicon fragments of CS3. The film bags in this case each have a packing density of 0.96 to 1.44 kg/dm$^3$, preferably of 1.08 to 1.32 kg/dm$^3$, and the double film bags each have a packing density of 0.75 to 1.13 kg/dm$^3$, preferably of 0.85 to 1.03 kg/dm$^3$.

Furthermore, the silicon fragments in question may be of CS4. The film bags here each have a packing density of 1.05 to 1.58 kg/dm$^3$, preferably of 1.18 to 1.45 kg/dm$^3$, and the double film bags each have a packing density of 0.73 to 1.09 kg/dm$^3$, preferably of 0.82 to 1 kg/dm$^3$.

The film bag or double film bag preferably comprises flat film bags (flat single bags) or flat double film bags. The term "flat bag" may be used below both for flat film bags (flat single bags) and for flat double film bags. The flat bags preferably have a contents weight of 10 kg.

Flat bags generally have no base and therefore lack stand-up stability. The category of flat bags also includes tubular bags, which can be produced from a film tube or from a film web. A feature of flat bags is usually that the bag length and the bag width in the filled state are at least twice the magnitude of the bag height.

The transport container contains preferably 8 to 14, more preferably 10 to 14, more particularly 11 to 13 flat single bags.

The transport container contains preferably 8 to 12, more preferably 9 to 11, more particularly 9 flat double film bags.

The transport container preferably has a length L which corresponds to the sum of a length l and a width b of the flat bag. The width B of the transport container corresponds preferably to the twofold width 2b of the flat bag, with the proviso that 2b corresponds at least to l. The height H of the transport container corresponds preferably to N*h, where h corresponds to the height of the filled flat bag and N corresponds to the number of layers of flat bags arranged one above another in the transport container. It may be necessary here to take account of the wall thickness of the transport container. Typical wall thicknesses are in the range from 4 to 20 mm, preferably in the range from 7 to 15 mm.

The length figures for the flat bag relate in principle to the bag in the filled state. The length figures of the transport container relate to its external dimensions.

A typical length L of the transport container is situated, for example, in a range from 70 to 80 cm. More particularly L may be about 76 cm, which corresponds to the width of a typical chemicals pallet (CP5). A typical width B is situated, for example, in a range from 50 to 60 cm. More particularly B may be about 57 cm, which corresponds to half the width of a CP5. A typical height H of the transport container is situated, for example, in a range from 20 to 40 cm, depending on the number of layers of flat bags it contains.

Typical flat bags may have a length l in a range from 30 to 70 cm, a width b in a range from to 45 cm and a height h in a range from 6 to 20 cm.

In the filled state, 10 kg flat bags preferably have a length l of 40 to 65 cm, have a width b of 25 to 30 cm and a height h of 7 to 12 cm.

One layer N in the transport container is formed preferably by at least two and not more than four flat bags. As far as the layer patterns described below are concerned, it is immaterial whether the bags in question are flat film bags or flat double film bags.

In the case of a layer of two flat bags (2N), the bags are arranged longitudinally or transversely (cf. FIG. 1). A 2N layer is used preferably as the uppermost layer if the layer below it has more than two flat bags.

Figure 2:
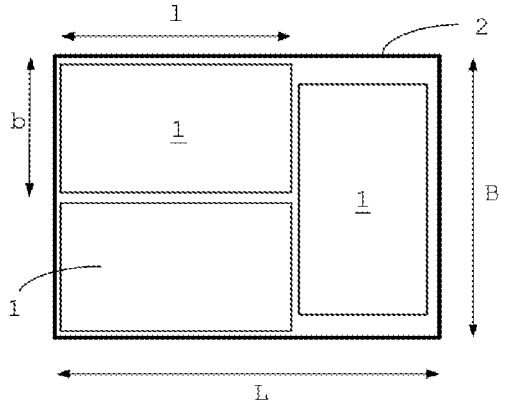

In the case of a layer of three flat bags (3N), these bags are arranged next to one another, with two of the flat bags being arranged longitudinally and one transversely (cf. FIG. 2).

Figure 3:
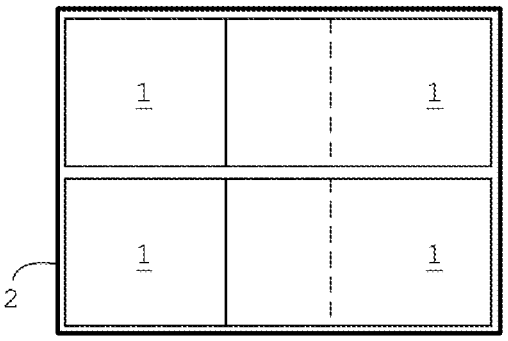

In the case of a layer of four flat bags (4N), two flat bags each are arranged longitudinally next to one another, with the two flat bags each arranged in longitudinal direction preferably overlapping (cf. FIG. 3).

If the transport container is loaded with eight 10 kg flat bags, it preferably has three layers with a layer sequence 3N, 3N, 2N, with the first-mentioned layer always being the bottom-most layer, located on the base of the transport container.

Figure 4:
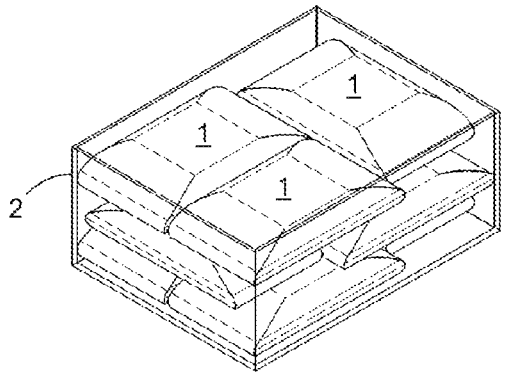

In the case of a load with nine 10 kg flat bags, the transport container preferably has a layer sequence 3N, 3N, 3N, (cf. FIG. 4).

In the case of a load with ten 10 kg flat bags, the transport container preferably has a layer sequence 4N, 3N, 3N.

In the case of a load with eleven 10 kg flat bags, the transport container preferably has a layer sequence 4N, 4N, 3N.

In the case of a load with twelve 10 kg flat bags, the transport container preferably has a layer sequence 3N, 3N, 3N, 3N.

In the case of a load with thirteen 10 kg flat bags, the transport container preferably has a layer sequence 4N, 3N, 3N, 3N.

In the case of a load with fourteen 10 kg flat bags, the transport container preferably has a layer sequence 4N, 4N, 3N, 3N.

For a layer sequence 3N, 3N, preferably one layer is arranged with a 180° rotation relative to the other layer, in relation to an axis of rotation running perpendicularly to the layer plane (cf. FIG. 4).

In particular, the height of the transport container containing eight to thirteen 10 kg flat bags is 30.9 to 33.4 cm. It has been found that a height of this kind enables optimal loading of 20-foot and 40-foot ISO containers.

According to another, alternative embodiment, the film bags or double film bags are upright bags, more particularly upright bags with a contents weight of 5 kg. The term "upright bag" is used below both for upright film bags (upright single film bags) and for upright double film bags.

A feature of upright bags is generally that they have stand-up stability after filling. The upright bag preferably has a square standing surface.

The transport container contains preferably 6 to 27, more preferably 9 to 18, of the upright bags.

A typical length L of the transport container for upright bags is situated, for example, in a range from 50 to 60 cm. More particularly L can be about 57 cm, which corresponds to half of the width of a typical chemicals pallet (CP3). A typical width B is situated, for example, in a range from 35 to 60 cm. More particularly B may be about 38 cm or 57 cm, corresponding to a third or half, respectively, of the width of a CP3. A typical height H of the transport container is situated, for example, in a range from 18 to 35 cm, depending on the number of layers of upright bags it contains.

Typical upright bags may have a length l in a range from 10 to 20 cm, a width b in a range from 10 to 20 cm and a height h in a range from 10 to 25 cm.

In the filled state, 5 kg upright bags preferably have a length l of 16 to 19 cm, a width b of 16 to 19 cm and a height h of 14 to 24 cm.

One layer in the transport container is formed preferably by six or nine upright bags with a square standing surface. Multiple layers are preferably arranged congruently one over another.

More particularly the height of a transport container comprising 5 kg upright bags is in each case 30.9 to 33.4 cm for a stack of three transport containers per pallet, in each case 23.2 to 25.1 cm for a stack of four transport containers and in each case 18.5 to 20 cm for a stack of five transport containers. It has emerged that such a height enables optimal loading of 20-foot and 40-foot ISO containers.

In general a paper or card insert sheet may be arranged between the layers or bags (irrespective of whether they are flat or upright bags). Such insert sheets may also consist of a plastic such as polyurethane, polyester or polystyrene.

Any residual volume present in the transport container may be filled up with cushioning elements. Consideration for this purpose is given, for example, to foams or shape-forming elements of polyurethane, polyester or expandable polystyrene. The filling of residual volume with paper or cardboard elements is likewise conceivable.

A further aspect of the invention relates to a pallet on which the transport containers described are arranged.

The pallet may in particular comprise standardized chemicals pallets (CP). The pallet in question is more particularly a pallet selected from the group comprising CP1 (dimensions: 100×120 cm), CP2 (80×120 cm), CP3 (114×114 cm), CP4 (110×130 cm) and CP5 (76×114 cm). CP1 to CP5 may also be referred to as runner pallets. The pallets used are preferably CP3 or CP5 with specific suitability for transporting ISO containers.

ISO containers (sea freight containers) are standardized large-scale containers for rapid and simple loading, conveying, storing and unloading of goods. The dimensions are selected so as to enable easy transport over land (road, rail, internal waterways). The commonest ISO containers have a width of 8 feet (2.438 m) and are either 20 feet (6.096 m) or 40 feet (12.192 m) long.

It has emerged that the transport container not only enables maximum possible space utilization in the palletizing of CP, especially CP3 and CP5, but also, in conjunction therewith, ensures optimal space utilization of 20-foot and 40-foot ISO containers loaded with the pallets.

The stacking of the transport containers on a pallet may take the form of column stacking or combination stacking.

Furthermore, the invention also encompasses freight containers, more particularly 20-foot or 40-foot ISO containers, containing the above-described pallets loaded with transport containers, more particularly CP3 and/or CP5 pallets.

Figure 5:
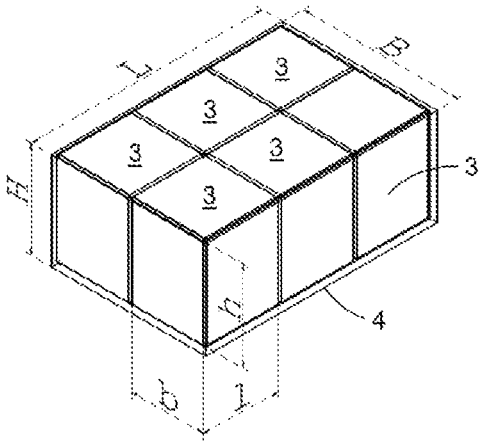
Figure 6:
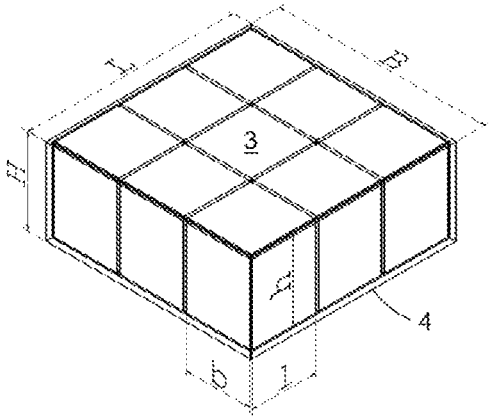
Figure 7:
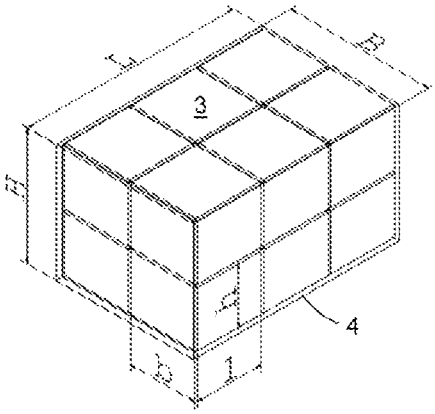
Figure 8:
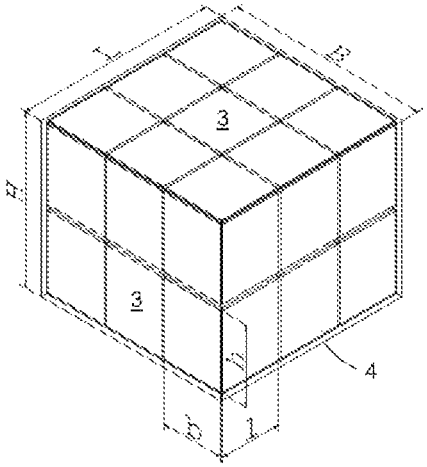
Figure 9:
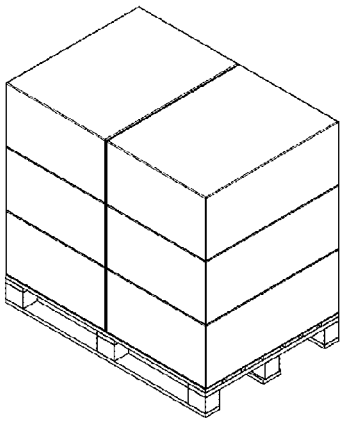
Figure 10:
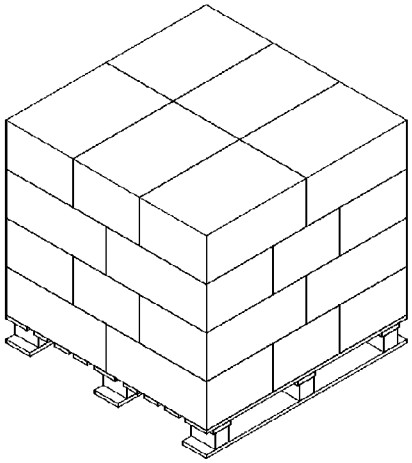
Figure 11:
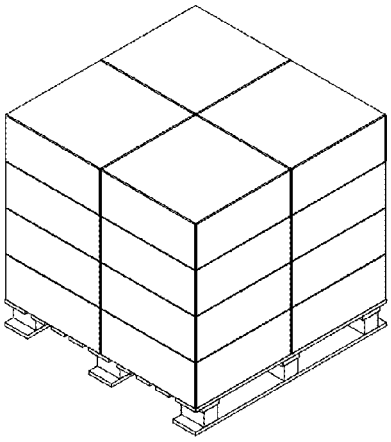
Figure 12:
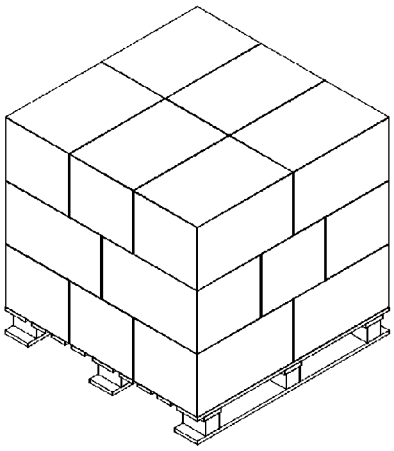
Figure 13:
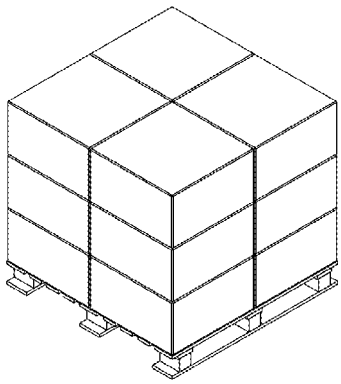
Figure 14:
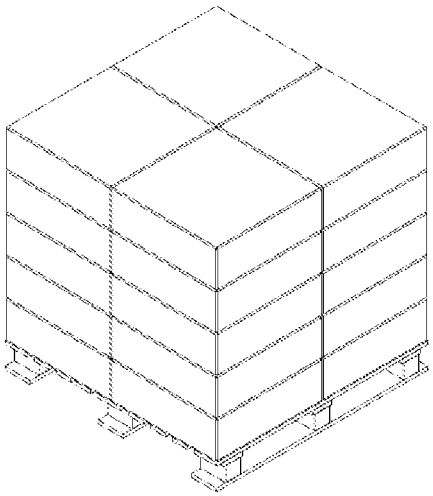

FIG. 1 shows layers of 2 flat bags.
FIG. 2 shows a layer of 3 flat bags.
FIG. 3 shows a layer of 4 flat bags.
FIG. 4 shows a transport container with 9 flat bags.
FIG. 5 shows a transport container with 6 upright bags.
FIG. 6 shows a transport container with 9 upright bags.
FIG. 7 shows a transport container with 12 upright bags.
FIG. 8 shows a transport container with 18 upright bags.
FIG. 9 shows a pallet with 6 transport containers.
FIG. 10 shows a pallet with 24 transport containers.
FIG. 11 shows a pallet with 16 transport containers.
FIG. 12 shows a pallet with 18 transport containers.
FIG. 13 shows a pallet with 12 transport containers.
FIG. 14 shows a pallet with 20 transport containers.

FIG. 1 shows, from above, a layer of two flat bags 1 in a transport container 2. The transport container 2 has a length L, which corresponds approximately to the sum of the length l and the width b of the flat bag 1. The width B corresponds approximately to twice the width b of the flat bag 1. Generally speaking, the lengthwise dimensions B and L of the transport container 2 may be chosen to be around 0 to 10% greater than necessary for the lengthwise dimensions b and/of the flat bags 1. The flat bags 1 may be arranged with their longitudinal side parallel to the longitudinal side or parallel to the latitudinal side of the transport container 2.

FIG. 2 shows a layer of three flat bags 1 in a transport container 2. The flat bags 2 are arranged next to one another and do not overlap. With regard to the dimensions of the flat bags 1 and of the transport container, reference may be made to the statements for FIG. 1.

FIG. 3 shows a layer of four flat bags 1 in a transport container 2. In this embodiment, pairs of flat bags 1 overlap with one another. In this case, preferably, the silicon fragments are not uniformly distributed. Instead, the fragments are located primarily in the non-overlapping part of the flat bags 1.

FIG. 4 shows a transport container 2 in which there are nine 10 kg flat bags 1. The flat bags 1 are arranged in three layers one above another. The layers are rotated by 180° from one another, so that only the topmost and bottom-most layers are congruent. The dimensions of the flat bags 1 are 1=46.5 cm, b=27.5 cm and h=9.8 cm. The height of the transport container 2 corresponds approximately to three times the height of the flat bags 1 and is H=32.4 cm. The length of the transport container is 76 cm, corresponding to the width of a CP5. The width of the transport container is 57 cm and corresponds to half the length of a CP5.

In principle, the various layer patterns according to FIGS. 1 to 3 may be combined arbitrarily with one another.

FIG. 5 shows a transport container 4 in which six 5 kg upright bags 3 with a square standing surface are arranged in one layer. The side length l and b of the upright bag 3 is 18.2 cm, the height h is 22.3 cm. The dimensions of the transport container 4 are H=24.3 cm, L=57 cm and B=38 cm.

FIG. 6 shows a transport container 4 in which nine 5 kg upright bags 3 with a square standing surface are arranged in one layer.

FIG. 7 shows a transport container 4 in which twelve 5 kg upright bags 3 with a square standing surface are arranged in two layers disposed congruently one over the other. The side length l and b of the upright bag 3 is 18.2 cm, the height h is 15.2 cm. The dimensions of the transport container 4 are H=32.4 cm, L=57 cm and B=38 cm.

FIG. 8 shows a transport container 4 in which 18 5 kg upright bags 3 with a square standing surface are arranged in two layers disposed congruently one over the other. The side length l and b of the upright bag 3 is 18.5 cm, the height h is 15.2 cm. The dimensions of the transport container 4 are H=32.4 cm, L=57 cm and B=57 cm.

FIGS. 9 to 14 are elucidated with reference to the examples.

EXAMPLES

1. Pallet (CP5) with Load Weight of 540 kg (FIG. 9)

A transport container contains nine double film bags (flat bags), each filled with 10 kg of polysilicon fragment of CS3 and having a packing density of 0.94 kg/dm$^3$. The bags are arranged in 3 layers as shown in FIG. 4. The dimensions of the bags and transport containers can be taken from the description for FIG. 4. The packing density of the transport container is 0.75 kg/dm$^3$. Six transport containers can be arranged in this way on a CP5. Thirty of these loaded CP5 fit into a 20-foot ISO container, corresponding to a net load weight of 16.2 t. With the existing transport containers, it has only been possible to realize a load weight of 14.4 t (cf. WO 2015/007490 A1).

2. Pallet (CP5) with a 600 kg Load Weight

A transport container contains ten flat double film bags, each filled with 10 kg of polysilicon fragment of CS2 and having a packing density of 0.96 kg/dm$^3$. Regarding the dimensions reference may be made to the 1$^{st}$ example. The packing density of the transport container is 0.84 kg/dm$^3$. The bags are arranged in three layers, with the bottom layer consisting of four bags (cf. FIG. 3). The CP5 may be loaded as shown in FIG. 9, with again thirty pallets fitting into a 20-foot ISO container. This corresponds to a net load weight of 18 t. With the existing transport containers, it has only been possible to realize a load weight of 14.4 t (cf. WO 2015/007490 A1).

3. Pallet (CP5) with a 720 kg Load Weight

A transport container contains twelve flat film bags, each filled with 10 kg of polysilicon fragment of CS2 and having a packing density of 1.34 kg/dm$^3$. Regarding the dimensions reference may be made to the 1$^{st}$ example. The bags are arranged in four layers each of three bags, with successive layers being rotated relative to one another as shown in FIG. 4. The packing density of the transport container is 1.00 kg/dm$^3$. The CP5 may be loaded as shown in FIG. 9, with again thirty pallets fitting into a 20-foot ISO container, corresponding to a net load weight of 21.6 t. In the case of a 20-foot standard ISO container with a maximum load weight of 21.67 t, 28 pallets are enough to utilize this load weight, including the packaging. This corresponds to a net load weight of 21.6 t. When using HT containers (hard-top containers with increased load weight), the container can be loaded with thirty pallets (net load weight: 21.6 t).

4. Pallet (CP5) with a 480 kg Load Weight

A transport container contains eight flat double film bags, each filled with 10 kg of polysilicon fragment of CS4 and having a packing density of 0.91 kg/dm$^3$. With regard to the dimensions, reference may be made to example 1. The packing density of the transport container is 0.67 kg/dm$^3$. The bags are arranged in three layers. The bottom two layers consist of three double bags (cf. FIG. 2) and the top layer of two bags (cf. FIG. 1). The CP5 is loaded as in FIG. 9, with again thirty pallets fitting into a 20-foot ISO container, corresponding to a net load weight of 14.4 t.

These examples show clearly that by virtue of the new mode of packaging, it is possible to achieve significant increases in the load weight of a pallet and hence also of the ISO container. As a result, the transport and logistics steps per kg of silicon over the entire life cycle of the product (from production through to processing, including disposal of the packaging materials) are reduced. Pack sizes are flexibly adjustable, through the use of different loadings of the transport container.

5. Pallet (CP3) with a 720 kg Load Weight (FIG. 10)

A transport container contains six upright film bags, each filled with 5 kg of polysilicon fragment of CS4 and having a packing density of 0.80 kg/dm$^3$. The bags, with a square standing surface, are arranged in one layer. For the dimensions, reference may be made to FIG. 5. The transport containers each have a packing density of 0.65 kg/dm$^3$. Twenty-four transport containers can be arranged in this way on a CP3 (combination stacking). Twenty of these CP3 fit into a 20-foot ISO container, corresponding to a net load weight of 14.4 t.

6. Pallet (CP3) with a 720 kg Load Weight (FIG. 11)

A transport container contains nine upright film bags, each containing 5 kg of polysilicon fragment of CS3 and having a packing density of 0.85 kg/dm$^3$. The side length l and b of the upright bags is 18.7 cm, the height h is 22.3 cm. The dimensions of the transport container are H=24.3 cm, L=57 cm and B=57 cm. The bags are arranged in one layer. The packing density of the transport containers is 0.64 kg/dm$^3$. The CP3 is loaded with 16 transport containers. In this way, twenty pallets fit into a 20-foot ISO container, corresponding to a net load weight of 14.4 t.

7. Pallet (CP3) with a 1080 kg Load Weight (FIG. 12)

A transport container contains twelve upright film bags, each filled with 5 kg of polysilicon fragment of CS2 and having a packing density of 0.96 kg/dm$^3$. The bags are arranged in two layers of 6 bags each. Regarding the dimensions, reference may be made to FIG. 7. The packing density of the transport containers is 0.95 kg/dm$^3$. The CP3 is loaded with 18 transport containers as shown in FIG. 12. Twenty pallets fit into a 20-foot ISO container, corresponding to a net load weight of 21.6 t. In the case of a 20-foot standard ISO container with a maximum load weight at 21.67 t, 18 pallets are sufficient to utilize this load weight, including the packaging. This corresponds to a net load weight of 19.44 t. When using HT containers, the container can be loaded with twenty pallets (net load weight: 21.6 t).

8. Pallet (CP3) with a 1080 kg Load Weight (FIG. 13)

A transport container contains 18 upright film bags, each filled with 5 kg of polysilicon fragment of CS3 and having a packing density of 0.95 kg/dm$^3$. The bags are arranged in two layers of 9 bags each (see FIG. 8). Regarding the dimensions, reference may be made to FIG. 8. The packing density of the transport containers is 0.94 kg/dm$^3$. The CP3 is loaded with twelve transport containers as shown in FIG. 13. Twenty pallets fit into a 20-foot ISO container, corresponding to a net load weight of 21.6 t. In the case of a 20-foot standard ISO container with a maximum load weight at 21.67 t, 18 pallets are sufficient to utilize this load weight, including the packaging. This corresponds to a net load weight of 19.44 t. When using HT containers, the container can be loaded with twenty pallets (net load weight: 21.6 t).

9. Pallet (CP3) with a 900 kg Load Weight (FIG. 14)

A transport container contains nine upright film bags, each containing 5 kg of polysilicon fragment of CS2 and each having a packing density of 0.90 kg/dm$^3$. The bags are arranged in one layer. The side length l and b of the upright bags is 18.7 cm, the height his 17.4 cm. The dimensions of the transport container are H=19.4 cm, L=57 cm and B=57 cm. The packing density of each transport container is 0.82 kg/dm$^3$. The CP3 is loaded with twenty transport containers. In this way, twenty pallets fit into a 20-foot ISO container, corresponding to a net load weight of 18.0 t.

Determination of the Fines Fraction

The determination was made by way of simulated transportation with typical exposures by transport vibrations on a truck bed over a distance of 800 km. Transport impacts, especially horizontal impacts on changeover of the pallets and/or transport containers, may correspond to two to three times the acceleration due to gravity (g). The simulation was carried out using a shaker plate.

Polysilicon of CS2 was transported in 10 kg flat double film bags in transport containers below. The fines fraction was ascertained subsequently by screening with a 2.0 mm mesh screen.

Comparative Transport Container 1 (Comp. TC1):

Eight 10 kg flat double film bags, arranged horizontally in four layers each of two bags in the transport packaging (cf. WO 2015/007490 A1). Six of these transport packages are located on one CP5 (480 kg). Transport package dimensions: 740×550×280 mm (L×B×H). Double film bag dimensions: 620×410 mm.

Transport container 2 (TC2) on pallet (CP5, 540 kg) in accordance with example 1 and FIG. 9).

Transport container 3 (TC3) on pallet (CP5, 540 kg) in accordance with example 4).

Table 1 shows the packing density of the flat double film bags, the fines fraction and the puncturing for 5 each (tests 1 to 5) transport containers studied. For each test, 960 kg of polysilicon (CS2) were evaluated for comp. TC1 and 1080 kg for TC2 and TC3. The puncturing (puncture rate) refers to punctures of the outer bag. The fines fraction for TC2 and TC3 is significantly lower than for cont. TC1. The punctures lie at a very low level and are not significantly different.

TABLE 1

| | Test | Packing density [kg/dm$^3$] | Fines fractions [ppm] | Puncturing |
|---|---|---|---|---|
| comp. | 1 | 0.702 | 3900 | 0% |
| TC1 | 2 | 0.702 | 3300 | 1% |
| | 3 | 0.702 | 4900 | 1% |
| | 4 | 0.702 | 3200 | 0% |
| | 5 | 0.702 | 3600 | 0% |
| | Average | 0.702 | 3780 | 0.4% |
| TC2 | 1 | 0.737 | 3200 | 1% |
| | 2 | 0.737 | 4500 | 2% |
| | 3 | 0.737 | 2700 | 2% |
| | 4 | 0.737 | 3200 | 0% |
| | 5 | 0.737 | 3000 | 1% |
| | Average | 0.737 | 3320 | 1.2% |
| TC3 | 1 | 0.702 | 4000 | 1% |
| | 2 | 0.702 | 3500 | 2% |
| | 3 | 0.702 | 2900 | 1% |
| | 4 | 0.702 | 3800 | 0% |
| | 5 | 0.702 | 3500 | 0% |
| | Average | 0.702 | 3540 | 0.8% |

The invention claimed is:

1. A transport container, comprises:

wherein the transport container comprises 8 to 14 flat film bags or 8 to 12 flat double film bags and wherein each are filled with silicon fragments;

wherein the flat film bags each have a packing density of 0.88 to 1.62 kg/dm$^3$ and wherein the flat double film bags each have a packing density of 0.68 to 1.15 kg/dm$^3$;

wherein the transport container containing the flat film bags has a packing density of 0.81 to 1.23 kg/dm$^3$ and the transport container containing the flat double film bags has a packing density of 0.65 to 1.06 kg/dm$^3$;

wherein the packing density of the flat film bag or flat double film bag is greater than or equal to the packing density of the transport container;

wherein the silicon fragments belong at least to one of the fragment size classes 0, 1, 2, 3 or 4, and wherein the transport container has a length L which corresponds to the sum of a length l and a width b of a flat bag, and has a width B which corresponds to the two-fold width 2b, wherein 2b must correspond at least to l, and wherein at least 2 and not more than 4 of the flat bags form a layer N in the transport container;

wherein for a layer of 2 flat bags 2N, the bags are arranged next to one another longitudinally or transversely;

wherein for a layer of 3 flat bags 3N, the bags are arranged next to one another, with 2 of the bags arranged longitudinally and one transversely; and wherein for a layer of 4 flat bags 4N, each 2 bags are arranged longitudinally next to one another, with the 2 bags each overlapping arranged in longitudinal direction.

2. The transport container of claim 1, wherein the flat film bags each have a packing density of 0.99 to 1.49 kg/dm$^3$ and the flat double film bags each have a packing density of 0.77 to 1.05 kg/dm$^3$.

3. The transport container of claim 1, wherein the transport container containing flat film bags has a packing density of 0.89 to 1.14 kg/dm$^3$ and the transport container containing flat double film bags has a packing density of 0.73 to 0.97 kg/dm$^3$.

4. The transport container of claim 1, wherein the silicon fragments are of fragment size class 0;

wherein the flat film bags each have a packing density of 0.9 to 1.34 kg/dm$^3$; and wherein the flat double film bags each have a packing density of 0.68 to 1.02 kg/dm$^3$.

5. The transport container of claim 1, wherein the silicon fragments are of fragment size class 1;

wherein the flat film bags each have a packing density of 0.88 to 1.32 kg/dm$^3$; and wherein the flat double film bags each have a packing density of 0.68 to 1.03 kg/dm$^3$.

6. The transport container of claim 1, wherein the silicon fragments are of fragment size class 2;

wherein the flat film bags each have a packing density of 1.07 to 1.61 kg/dm$^3$; and wherein the flat double film bags each have a packing density of 0.76 to 1.15 kg/dm$^3$.

7. The transport container of claim 1, wherein the silicon fragments are of fragment size class 3;

wherein the flat film bags each have a packing density of 0.96 to 1.44 kg/dm$^3$; and wherein the flat double film bags each have a packing density of 0.75 to 1.13 kg/dm$^3$.

8. The transport container of claim 1, wherein the silicon fragments are of fragment size class 4;

wherein the flat film bags each have a packing density of 1.05 to 1.58 kg/dm$^3$; and wherein the flat double film bags each have a packing density of 0.73 to 1.09 kg/dm$^3$.

9. The transport container of claim 1, wherein the flat film bags or flat double film bags have a contents weight of 10 kg.

10. The transport container of claim 1, wherein the transport container comprises 10 to 14 flat film bags.

11. The transport container of claim 1, wherein the transport container comprises 9 to 11 flat double film bags.

12. The transport container of claim 1, wherein the first-mentioned layer corresponds to the bottom-most layer; and wherein when the transport container is used for loading with 8 flat bags the transport container has a layer sequence 3N, 3N, 2N, or wherein when the transport container is used for loading with 9 flat bags the transport container has a layer sequence 3N, 3N, 3N, or wherein when the transport container is used for loading with 10 flat bags the transport container has a layer sequence 4N, 3N, 3N, or wherein when the transport container is used for loading with 11 film bags the transport container has a layer sequence 4N, 4N, 3N, or wherein when the transport container is used for loading with 12 flat bags the transport container has a layer sequence 4N, 4N, 4N or 3N, 3N, 3N, 3N, or wherein when the transport container is used for loading with 13 flat bags the transport container has a layer sequence 4N, 3N, 3N, 3N, or wherein when the transport container is used for loading with 14 flat bags the transport container has a layer sequence 4N, 4N, 3N, 3N.

13. The transport container of claim 1, wherein the transport container is arranged on a pallet.

14. The transport container of claim 13, wherein one or more pallets having the transport containers arranged thereon are contained within a freight container.

* * * * *